US010253603B2

(12) United States Patent
Grattan et al.

(10) Patent No.: US 10,253,603 B2
(45) Date of Patent: Apr. 9, 2019

(54) METHODS OF CONTROLLING THE DYNAMIC PRESSURE CREATED DURING DETONATION OF A SHAPED CHARGE USING A SUBSTANCE

(71) Applicant: Halliburton Energy Services, Inc., Houston, TX (US)

(72) Inventors: Antony Forbes Grattan, Mansfield, TX (US); Dennis James Haggerty, Burleson, TX (US); Corbin S. Glenn, Burleson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 641 days.

(21) Appl. No.: 14/765,564

(22) PCT Filed: Feb. 5, 2013

(86) PCT No.: PCT/US2013/024766
§ 371 (c)(1),
(2) Date: Aug. 3, 2015

(87) PCT Pub. No.: WO2014/123510
PCT Pub. Date: Aug. 14, 2014

(65) Prior Publication Data
US 2015/0376992 A1 Dec. 31, 2015

(51) Int. Cl.
*E21B 43/117* (2006.01)

(52) U.S. Cl.
CPC ..... *E21B 43/117* (2013.01)

(58) Field of Classification Search
CPC ..... E21B 43/117; E21B 29/02; E21B 43/116; E21B 2021/006; E21B 43/263; F42B 1/02; F42B 1/032; F42B 3/22; C06B 33/08
See application file for complete search history.

(56) References Cited

U.S. PATENT DOCUMENTS 8,381,652 B2 * 2/2013 Glenn ..... F42B 1/028 102/306
8,701,767 B2 * 4/2014 Andrzejak ..... C06B 33/08 102/306

(Continued)

OTHER PUBLICATIONS

International Search Report dated Oct. 25, 2013; PCT International Application No. PCT/US2013/024766.

*Primary Examiner* — Daniel P Stephenson
(74) *Attorney, Agent, or Firm* — McGuireWoods LLP

(57) ABSTRACT

A method of controlling a dynamic pressure created during detonation of a shaped charge comprises: positioning the shaped charge in a wellbore, wherein the shaped charge comprises a main explosive load, wherein a substance is included in the main explosive load or is positioned adjacent to the main explosive load, wherein the substance increases or decreases the dynamic pressure or increases or decreases the duration of a pressure pulse created during detonation of the shaped charge; whereas a substantially identical shaped charge without the substance does not increase or decrease the dynamic pressure nor increase or decrease the duration of the pressure pulse during detonation. A method of controlling the balance of a portion of a wellbore comprises: positioning the shaped charge in the portion of the wellbore; and creating a desired balance in the portion of the wellbore.

22 Claims, 4 Drawing Sheets

(56) References Cited

U.S. PATENT DOCUMENTS

| | | | | |
|---|---|---|---|---|
| 9,062,534 | B2 * | 6/2015 | Evans | E21B 43/117 |
| 9,080,432 | B2 * | 7/2015 | Yang | E21B 43/117 |
| 9,291,039 | B2 * | 3/2016 | King | B22F 3/1258 |
| 9,383,176 | B2 * | 7/2016 | Arguello | F42B 1/036 |
| 9,470,483 | B1 * | 10/2016 | Wang | F42B 3/22 |
| 9,644,460 | B2 * | 5/2017 | Bell | E21B 43/117 |
| 9,671,201 | B2 * | 6/2017 | Marya | F42B 3/22 |
| 9,862,027 | B1 * | 1/2018 | Loehken | B22F 1/0011 |
| 2003/0037692 | A1 * | 2/2003 | Liu | C06B 33/00 102/301 |
| 2010/0132945 | A1 | 6/2010 | Bell et al. | |
| 2010/0133005 | A1 | 6/2010 | Bell et al. | |
| 2011/0056362 | A1 | 3/2011 | Yang et al. | |
| 2011/0094406 | A1 | 4/2011 | Marya et al. | |
| 2013/0008655 | A1 | 1/2013 | Le et al. | |
| 2015/0362297 | A1 * | 12/2015 | Yang | E21B 43/117 102/307 |
| 2015/0376992 | A1 * | 12/2015 | Grattan | E21B 43/117 175/4.57 |

* cited by examiner

METHODS OF CONTROLLING THE DYNAMIC PRESSURE CREATED DURING DETONATION OF A SHAPED CHARGE USING A SUBSTANCE

TECHNICAL FIELD

Methods of controlling the dynamic pressure created during detonation of a shaped charge and the balance of a portion of a wellbore are provided. A substance can be included in, or adjacent to, the main explosive load of the shaped charge. The substance can increase or decrease the dynamic pressure or increase or decrease the duration of a pressure pulse created during detonation. The dynamic pressure can be increased or decreased via the substance increasing or decreasing the heat of explosion of the main explosive load. The control of the dynamic pressure or the duration of the pressure pulse can be used to control the balance of the wellbore portion and provide for a balanced, over-balanced, or under-balanced wellbore portion.

SUMMARY

According to an embodiment, a method of controlling a dynamic pressure created during detonation of a shaped charge comprises: positioning the shaped charge in a wellbore, wherein the shaped charge comprises a main explosive load, wherein a substance is included in the main explosive load or is positioned adjacent to the main explosive load, wherein the substance increases or decreases the dynamic pressure or increases or decreases the duration of a pressure pulse created during detonation of the shaped charge; whereas a substantially identical shaped charge without the substance does not increase or decrease the dynamic pressure nor increase or decrease the duration of the pressure pulse during detonation.

According to another embodiment, a method of controlling the balance of a portion of a wellbore comprises: positioning a shaped charge in the portion of the wellbore, wherein the shaped charge comprises a main explosive load, wherein a substance is included in the main explosive load or is positioned adjacent to the main explosive load; and creating a desired balance in the portion of the wellbore, wherein the desired balance is created by increasing or decreasing a dynamic pressure or increasing or decreasing the duration of a pressure pulse created during detonation of the shaped charge, wherein the substance increases or decreases the dynamic pressure or increases or decreases the duration of the pressure pulse created during detonation of the shaped charge; whereas a substantially identical shaped charge without the substance does not increase or decrease the dynamic pressure nor increase or decrease the duration of the pressure pulse during detonation.

BRIEF DESCRIPTION OF THE FIGURES

The features and advantages of certain embodiments will be more readily appreciated when considered in conjunction with the accompanying figures. The figures are not to be construed as limiting any of the preferred embodiments.

DETAILED DESCRIPTION

Figure 1:
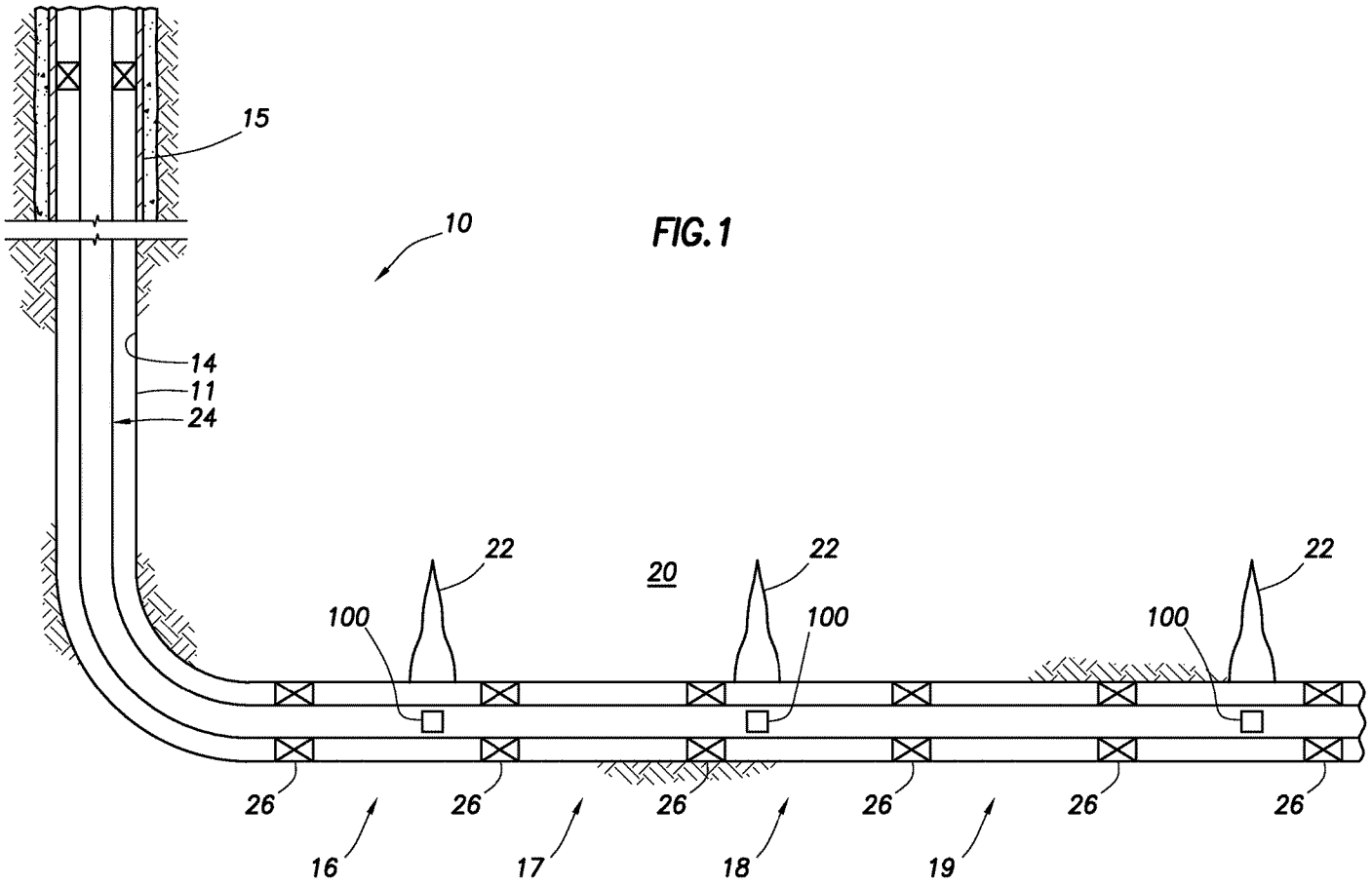
FIG. 1 depicts a wellbore comprising a shaped charge.

As used herein, the words "comprise," "have," "include," and all grammatical variations thereof are each intended to have an open, non-limiting meaning that does not exclude additional elements or steps.

As used herein, the word "substance" means elements, molecules, or mixtures having a definite composition and properties. A substance is intended to include, for example, pure elements, alloys, metals, polymers, compounds, mixtures, and combinations thereof. No molecule, mixture, or other material is intended to be excluded by the use of the word "substance."

Shaped charges are used in a variety of applications, such as military and non-military applications. In non-military applications, shaped charges are used: in the demolition of buildings and structures; for cutting through metal piles, columns and beams; for boring holes; and in steelmaking, quarrying, breaking up ice, breaking log jams, felling trees, and drilling post holes. Another common non-military application is the oil and gas industry.

Oil and gas hydrocarbons are naturally occurring in some subterranean formations. A subterranean formation containing oil or gas is sometimes referred to as a reservoir. A reservoir may be located under land or off shore. Reservoirs are typically located in the range of a few hundred feet (shallow reservoirs) to a few tens of thousands of feet (ultra-deep reservoirs). In order to produce oil or gas, a wellbore is drilled into a reservoir or adjacent to a reservoir.

A well can include, without limitation, an oil, gas, or water production well, or an injection well. As used herein, a "well" includes at least one wellbore. A wellbore can include vertical, inclined, and horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet of the wellbore.

A portion of a wellbore may be an open hole or cased hole. In an open-hole wellbore portion, a tubing string may be placed into the wellbore. The tubing string allows fluids to be introduced into or flowed from a remote portion of the wellbore. In a cased-hole wellbore portion, a casing is placed into the wellbore that can also contain a tubing string. The casing can be cemented in place in the wellbore.

Stimulation techniques can be used to help increase or restore oil, gas, or water production of a well. One example of a stimulation technique is a perforation of a well by using shaped charges. The shaped charges can be detonated, thereby creating a hole in the casing and cement, wherein the hole extends into the subterranean formation. The hole extending into the formation is called a perforation tunnel. The perforation tunnel opens the wellbore to the formation. The perforation tunnel may also allow fracturing fluids to access the formation more easily.

A shaped charge generally includes a conically-shaped charge case, a solid explosive load, a liner, a central booster, array of boosters, or detonation wave guide, and a hollow cavity forming the shaped charge. If the hollow cavity is lined with a thin layer of metal, plastic, ceramic, or similar materials, the liner forms a jet when the explosive charge is detonated. Upon initiation, a spherical wave propagates outward from the point of initiation, in the basic case of a single point initiated charge, initiated along the axis of symmetry. This high pressure wave moves at a very high velocity, typically around 8 kilometers per second (km/s), and is commonly called the duration of the pressure pulse. As the detonation wave engulfs the lined cavity, the liner material is accelerated under the high detonation pressure, thereby collapsing the liner. During this process, for a typical conical liner, the liner material is driven to very violent distortions over very short time intervals (microseconds) at strain rates of 104 to 107/s. Maximum strains greater than 10 can be readily achieved since superimposed on the deformation are very large dynamic pressures (peak pressures of approximately 200 gigapascals "GPa" (30 million pounds force per square inch "psi"), decaying to an average of approximately 20 GPa. The collapse of the liner material on the centerline forces a portion of the liner to flow in the form of a jet where the jet tip velocity can travel in excess of 10 km/s. The conical liner collapses progressively from apex to base under point initiation of the high explosive. A portion of the liner flows into a compact slug (sometimes called a carrot), which is the large massive portion at the rear of the jet. The duration of the pressure pulse can be determined based in part on the relative speed at which the material of the explosive load detonates or burns. For example, some materials can burn at a slower rate compared to other materials, and thus, the material that burns slower will have a longer pressure pulse compared to the other materials.

A shaped charge can be included in a perforating gun assembly. The perforating gun assembly can include a charge tube containing holes whereby a shaped charge can be inserted in the hole of the tube. A detonation cord can be positioned inside the charge tube and link each shaped charge with each other. The charge tube, shaped charges, and possibly a detonator, can be inserted into a carrier. The perforating gun assembly can then be placed into a wellbore and is generally lowered into the wellbore on either tubing or a wire line until the assembly reaches the desired location within the wellbore. When the charges are detonated, particles are expelled, forming a high-velocity jet that creates a pressure wave that exerts pressure on the formation and possibly the casing for a cased-hole portion. The detonation creates the perforation tunnel by forcing material radially away from the jet axis.

During the detonation of a shaped charge, the pressure differential between the wellbore and the subterranean formation can be affected. An over-balance is created when the amount of pressure in the wellbore exceeds the pore pressure in the formation. An over-balance occurs when the pressure differential between the wellbore and the formation is positive. An under-balance is created when the amount of pressure in the wellbore is less than the amount of pore pressure in the formation. An under-balance occurs when the pressure differential between the wellbore and the formation is negative. A balanced wellbore is when the amount of pressure in the wellbore equals the pore pressure in the formation (i.e., there is not a pressure differential between the wellbore and the formation).

Dynamic pressures can oscillate for a few hundredths of a second as the explosive detonation, high-velocity jets and shock waves pass through wellbore fluids. Moreover, wellbore pressures can vary significantly immediately after shaped-charge detonation. When a shaped charge is detonated, the sudden opening between the newly-formed perforation tunnel and the formation generally creates an under balance because fluids can more quickly and easily flow from the higher-pressure formation to the lower pressure wellbore. An over balance can be created when the perforating shock waves and high-impact pressure is greater than the pore pressure resulting in shattered rock grains, breaking down inter-granular mineral cementation and de-bonding clay particles, resulting in some of the material becoming lodged creating a crushed zone in the walls of the newly-formed perforation tunnel. The lodged material can lower the permeability of the tunnel which can slow fluids from entering the wellbore and can thus create the over balance. A clean perforation tunnel, by contrast, is a tunnel whereby no material or very little material becomes lodged in the tunnel whereby fluids will flow more easily into or from the wellbore; thereby increasing the overall production of the well and recovery over time. This can be accomplished, for example, when the dynamic pressure during detonation is lower or the pore pressure of the formation is higher. Any material that does flow into the newly-created tunnel can be sucked back into the wellbore due to the underbalance.

There is a need to control the dynamic pressure created during the detonation of a shaped charge that creates a perforation tunnel. This can be accomplished by controlling the heat of explosion of the components or ingredients of the shaped charge or by controlling the duration of a pressure pulse created during detonation of the shaped charge. The heat of explosion or the duration of the pressure pulse can be adjusted in order to provide a desired balance of the wellbore (e.g., balanced, over-balanced, or under-balanced wellbore).

It has been discovered that a substance that either increases or decreases the dynamic pressure and possibly also the overall heat of explosion or increases or decreases the duration of the pressure pulse can be included within or adjacent to the main explosive load of a shaped charge. The substance can be used to control the balance of the wellbore, for example, by increasing or decreasing the dynamic pressure created during detonation of a shaped charge, creating an elongated or shortened pressure pulse into the subterranean formation and/or increasing or decreasing the velocity of the high-pressure wave during detonation.

According to an embodiment, a method of controlling a dynamic pressure created during detonation of a shaped charge comprises: positioning the shaped charge in a wellbore, wherein the shaped charge comprises a main explosive load, wherein a substance is included in the main explosive load or is positioned adjacent to the main explosive load, wherein the substance increases or decreases the dynamic pressure or increases or decreases the duration of a pressure pulse created during detonation of the shaped charge; whereas a substantially identical shaped charge without the substance does not increase or decrease the dynamic pressure nor increases or decreases the duration of a pressure pulse during detonation.

According to another embodiment, a method of controlling the balance of a portion of a wellbore comprises: positioning a shaped charge in the portion of the wellbore, wherein the shaped charge comprises a main explosive load, wherein a substance is included in the main explosive load or is positioned adjacent to the main explosive load; and creating a desired balance in the portion of the wellbore, wherein the desired balance is created by increasing or decreasing a dynamic pressure or increasing or decreasing the duration of a pressure pulse created during detonation of the shaped charge, wherein the substance increases or decreases the dynamic pressure or increases or decreases the duration of a pressure pulse created during detonation of the shaped charge; whereas a substantially identical shaped charge without the substance does not increase or decrease the dynamic pressure nor increase or decrease the duration of a pressure pulse during detonation.

Any discussion of the embodiments regarding the method is intended to apply to all of the method embodiments. Any discussion of a particular component of an embodiment (e.g., a shaped charge or a substance) is meant to include the singular form of the component and also the plural form of the component, without the need to continually refer to the component in both the singular and plural form throughout. For example, if a discussion involves "the shaped charge 100," it is to be understood that the discussion pertains to one shaped charge (singular) and two or more shaped charges (plural).

Turning to the Figures, FIG. 1 depicts a well system 10 containing multiple shaped charges 100 located within multiple zones of the well system. The well system can be off-shore. The well system 10 can include at least one wellbore 11. The wellbore 11 can penetrate a subterranean formation 20. The subterranean formation 20 can be a portion of a reservoir or adjacent to a reservoir. The wellbore 11 can have a generally vertical cased or uncased section 14 extending downwardly from a casing 15, as well as a generally horizontal cased or uncased section extending through the subterranean formation 20. The wellbore 11 can include only a generally vertical wellbore section or can include only a generally horizontal wellbore section.

A tubing string 24 (such as a stimulation tubing string or coiled tubing) can be installed in the wellbore 11. The well system 10 can comprise at least a first zone 16 and a second zone 17. The well system 10 can also include more than two zones, for example, the well system 10 can further include a third zone 18, a fourth zone 19, and so on. According to an embodiment, the well system 10 includes anywhere from 2 to hundreds or thousands of zones. The zones can be isolated from one another in a variety of ways known to those skilled in the art. For example, the zones can be isolated via multiple packers 26. The packers 26 can seal off an annulus located between the outside of the tubing string 24 and the wall of wellbore 11.

It should be noted that the well system 10 is illustrated in the drawings and is described herein as merely one example of a wide variety of well systems in which the principles of this disclosure can be utilized. It should be clearly understood that the principles of this disclosure are not limited to any of the details of the well system 10, or components thereof, depicted in the drawings or described herein. Furthermore, the well system 10 can include other components not depicted in the drawing. For example, the well system 10 can further include a well screen. By way of another example, cement may be used instead of packers 26 to isolate different zones. Cement may also be used in addition to packers 26.

The well system 10 does not need to include a packer 26. Also, it is not necessary for one well screen and one shaped charge 100 to be positioned between each adjacent pair of the packers 26. It is also not necessary for a single shaped charge 100 to be used in conjunction with a single well screen. Any number, arrangement and/or combination of these components may be used.

Figure 2:
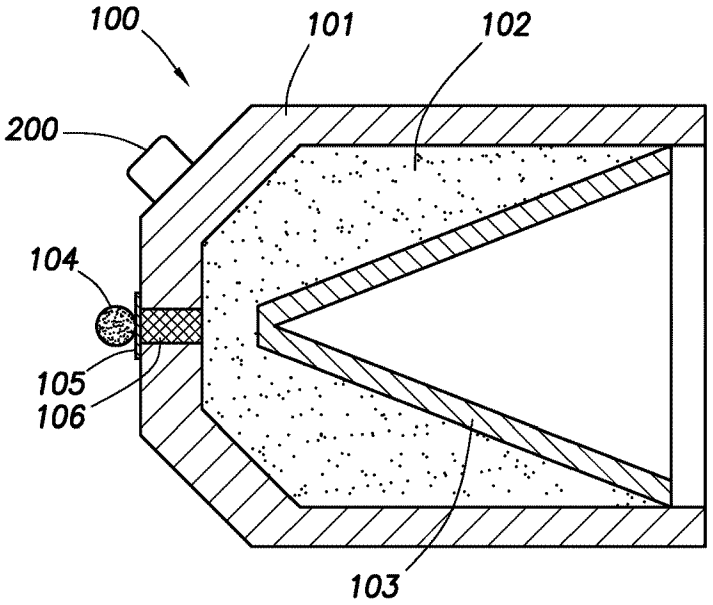

As can be seen in FIG. 2, the shaped charge 100 includes a main explosive load 102. The shaped charge 100 can further include a charge case 101, wherein the charge case 101 is positioned adjacent to the main explosive load 102. The charge case 101 can comprise a metal or metal alloy. As used herein, the term "metal alloy" means a mixture of two or more elements, wherein at least one of the elements is a metal. The other element(s) can be a non-metal or a different metal. An example of a metal and non-metal alloy is steel, comprising the metal element iron and the non-metal element carbon. An example of a metal and metal alloy is bronze, comprising the metallic elements copper and tin. The metal or metal alloy of the charge case 101 can be selected from the group consisting of aluminum, zinc, magnesium, titanium, tantalum, and combinations thereof.

The shaped charge 100 can further comprise a liner 103, wherein the liner 103 is positioned adjacent to the main explosive load 102. The shaped charge 100 can be an open-faced charge. Examples of open-faced charges include, but are not limited to, deep-penetrating (DP) charges, big hole (BH) charges, Good Hole (GH) charges, Frac Charges, reactive liner charges and other embodiments designed to suit specific performance objectives generally referred to as rock optimized charges. As can be seen in FIG. 2, the shaped charge 100 can include a liner 103, the main explosive load 102, and a charge case 101, wherein the liner 103 is positioned adjacent to the main explosive load 102 and the charge case 101 is positioned adjacent to the other side of the main explosive load 102. Liners can be made from a variety of materials, including various metals and glass. Common metals include copper, aluminum, tungsten, tantalum, depleted uranium, lead, tin, cadmium, cobalt, magnesium, titanium, zinc, zirconium, molybdenum, beryllium, nickel, silver, gold, platinum, and pseudo-alloys of tungsten filler and copper binder. The selection of the material depends on many factors including economic drivers as well as performance requirements. For example, a copper and lead powdered matrix pressed into a final geometric form has been found to work well for the oil and gas industry, historically with higher performance embodiments comprising increasing amounts of tungsten powder within the metal matrix. The liner 103 can have a thickness of at least 0.025 inches (in). According to another embodiment, the liner 103 has a thickness in the range of about 0.025 to about 0.250 in, preferably of about 0.025 to about 0.100 in.

The shaped charge 100 can further comprise a central booster, array of boosters, or detonation wave guide (shown in FIG. 2 as a central booster 106). According to an embodiment, the central booster, array of boosters, or detonation wave guide is capable of detonating the main explosive load 102. Detonation means a supersonic exothermic front accelerating through a medium that eventually drives a shock front or wave that propagates directly in front of the explosive load. The shaped charge 100 can further include a seal disc 105 and a detonation cord 104. According to an embodiment, the detonation cord 104 is capable of initiating the central booster, array of boosters, detonation wave guide, or the main explosive load 102. If more than one shaped charge 100 is positioned in the wellbore 11, then the detonation cord 104 can be connected to, and link, two or more of the shaped charges 100 together.

Figure 7:
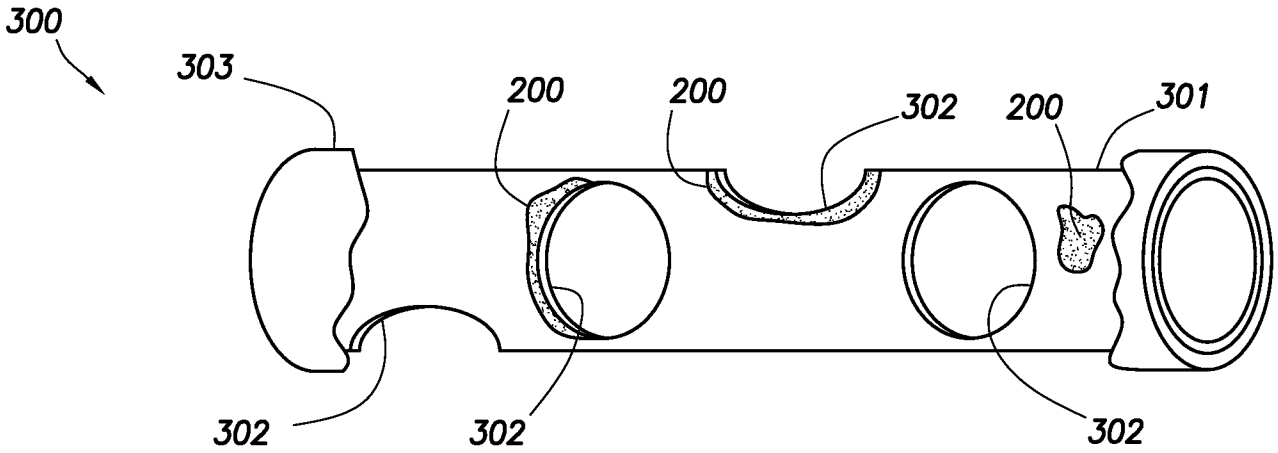
FIG. 7 depicts a perforating gun assembly containing the substance.

As shown in FIG. 7, the shaped charge 100 can be included in a perforating gun assembly 300. The perforating gun assembly 300 can include a charge tube 301. The charge tube 301 can comprise one or a plurality of holes 302. The holes 302 can be for receiving a shaped charge 100. The detonation cord 104 linking each shaped charge 100 can be positioned inside the charge tube 301. The perforating gun assembly 300 can also include a carrier 303. The charge tube 301 containing the shaped charge 100, and possibly other components such as the detonation cord 104, can be inserted into the carrier 303. The charge tube 301 and the carrier 303 can be made from a variety of materials known to those skilled in the art.

According to an embodiment, a substance 200 is included in the main explosive load 102. The main explosive load 102 can further comprise an explosive material. The explosive material can be selected from commercially-available materials. For example, the explosive material can be selected from the group consisting of [3-Nitrooxy-2,2-bis(nitrooxymethyl)propyl]nitrate "PETN"; 1,3,5-Trinitroperhydro-1,3,5-triazine "RDX"; Octahydro-1,3,5,7-tetranitro-1,3,5,7-tetrazocine "HMX"; 1,3,5-Trinitro-2-[2-(2,4,6-trinitrophenyl)ethenyl]benzene "HNS"; 2,6-bis,bis(picrylamino)-3,5-dinitropyridine "PYX"; 1,3,5-trinitro-2,4,6-tripicrylbenzene "BRX"; 2,2',2",4,4',4",6,6',6"-nonanitro-m-terphenyl "NONA"; and combinations thereof. According to an embodiment, the main explosive load 102 further comprises a de-sensitizing material. The de-sensitizing material can be capable of binding the main explosive load 102 together. The de-sensitizing material can also help the main explosive load 102 retain its shape. The de-sensitizing material can be selected from the group consisting of a wax, graphite, plastics, thermoplastics, fluoropolymers (e.g., polytetrafluoroethylene), other non-energetic (inert) binders, and combinations thereof. The main explosive load 102 can also comprise more than one substance 200. According to this embodiment, the substance 200 can be a variety of shapes and sizes (discussed in further detail below). The substance 200 can be included in the main explosive load 102 via one or more de-sensitizers or binders.

According to another embodiment, the substance 200 is positioned adjacent to the main explosive load 102. FIG. 2 depicts an embodiment of the substance 200 being positioned adjacent to the main explosive load 102. The substance 200 can be included in the charge case 101. The substance 200 can be included within the material making up the charge case 101, the substance 200 can be attached to the charge case 101 (depicted in FIG. 2 in the shape of a nugget), or the substance 200 can fully or partially coat the outside or inside of the charge case 101.

Figure 3:
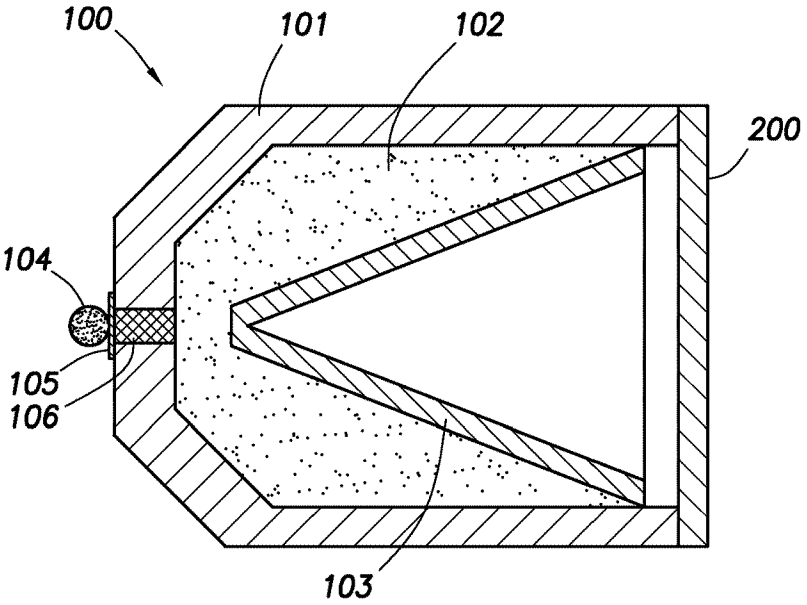
FIGS. 2-5 depict a shaped charge containing a substance according to certain embodiments.

FIG. 3 depicts the substance 200 being positioned adjacent to the main explosive load 102 according to another embodiment. The substance 200 can be applied to the open-face portion of the charge case 101. The substance 200 can be circular in shape. For example, the substance 200 can be a circular disc. The substance 200 can further comprise an adhesive (not shown). The adhesive can be located on one side of the substance 200. The adhesive can be located around the perimeter of the substance 200. The adhesive can have a width such that at least a portion of the thickness (i.e., the difference between the inner diameter and the outer diameter) of the base of the charge case 101 can be contacted by the adhesive. According to an embodiment, the adhesive has a width greater than or equal to the thickness of the base of the charge case 101. In this manner, the adhesive can completely cover the entire thickness of the base of the charge case 101. The methods can further include the step of applying the substance 200 to the charge case 101 via affixing the adhesive to the base of the charge case 101. The adhesive can be permanent or removable. If the adhesive is permanent, then once the substance 200 is applied to the base of the charge case 101, the substance is not easily removed from the charge case. For example, during assembly of the charge and/or during positioning of the charge at the desired detonation location, the substance does not become removed from the charge case. However, it is to be understood that the use of the word permanent does not imply that at least a portion of the substance is never removed from the charge case because during detonation some or all of the substance can be removed from the charge case.

Figure 4:
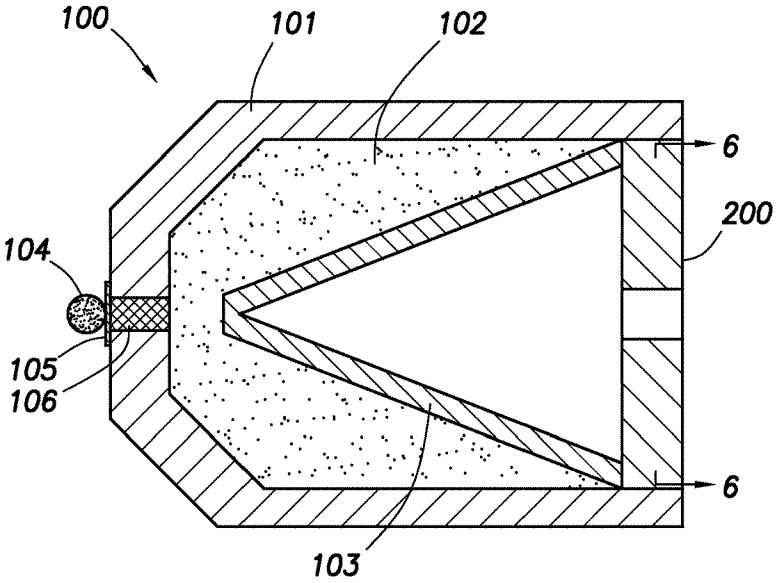

FIG. 4 depicts the substance 200 being positioned adjacent to the main explosive load 102 according to another embodiment. The substance 200 can be positioned in the open-face portion of the charge case 101 within the inner diameter of the charge case 101. In this embodiment, the substance 200 can be secured in the open-face portion in a variety of ways, for example, via an adhesive surrounding at least a portion of the outer diameter of the substance 200.

Figure 5:
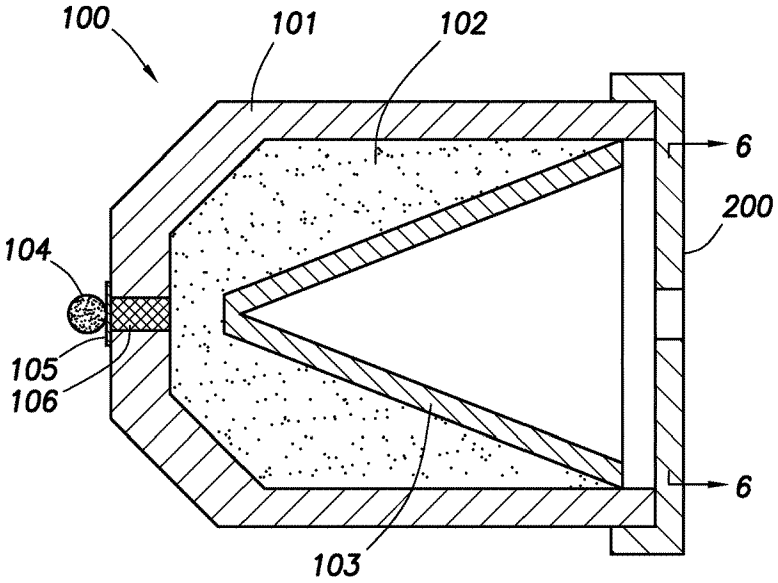

FIG. 5 depicts the substance 200 being positioned adjacent to the main explosive load 102 according to another embodiment. The substance 200 can include one or more protrusions making up the outer diameter of the substance. The protrusions can be used to help secure the substance 200 to the outside of the base of the charge case 101. The protrusions can be a clamp-like protrusion. The shape, size, and location of the protrusions can be selected such that the substance 200 is capable of being permanently or removably attached to the outside of the base of the charge case 101.

Figure 6:
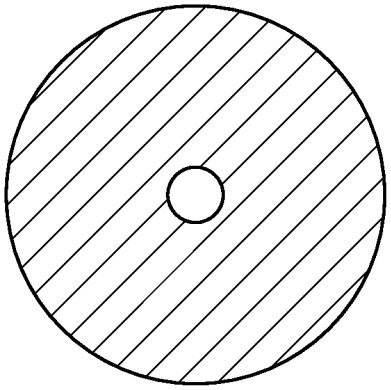
FIG. 6 depicts another embodiment of the substance of FIGS. 3-5.

FIG. 6 depicts the substance 200 according to FIGS. 3-5 taken along line 4. As can be seen, the substance 200 can be circular in shape. The substance 200 can be solid or can include one or more holes. The hole can be used to ensure that the substance 200 does not adversely affect the performance of the shaped charge 100. For example, the substance 200 does not prevent or restrict the main explosive load 102 from detonating. The hole could also be sized such that the substance does not interfere with the formation of the jet.

Turning to FIG. 7, the substance 200 can be included in the perforating gun assembly 300. Preferably, the substance 200 is included in the charge tube 301. As can be seen in FIG. 7, the substance 200 can be included in the material making up the charge tube 301. The substance 200 can also partially or fully surround the outer perimeter of one or more holes 302 of the charge tube 301. The substance 200 can also partially or fully line the inside (inner diameter) of the carrier 303. The substance 200 can also partially or fully line the inside (inner diameter) or the outside (outer diameter) of the charge tube 301. The substance 200 can be applied to the carrier 303 or the charge tube 301 via a spraying apparatus or any other applicator known to those skilled in the art.

The substance 200 is capable of increasing or decreasing, or increases or decreases, the dynamic pressure created during detonation of the shaped charge 100; whereas, a substantially identical shaped charge without the substance is not capable of increasing or decreasing, or does not increase or decrease, the dynamic pressure during detonation. The substance 200 is also capable of increasing or decreasing, or increases or decreases, the duration of the pressure pulse created during detonation of the shaped charge 100; whereas, a substantially identical shaped charge without the substance is not capable of increasing or decreasing, or does not increase or decrease the duration of the pressure pulse during detonation. As used herein, the phrase "substantially identical" means the device contains the same components, materials, concentrations of materials, etc. with the exception of the component or material specifically excluded. The increase or decrease in the dynamic pressure or the increase or decrease in the duration of the pressure pulse can be a desired value. An increase in the duration of the pressure pulse can include creating an elongated pressure pulse. A decrease in the duration of the pressure pulse can include creating a shortened pressure pulse. It is to be understood that the dynamic pressure may, but does not have to increase or decrease when the substance is used to increase or decrease the duration of the pressure pulse.

According to an embodiment, the methods include the step of creating a desired balance of a portion of a wellbore. It is to be understood that the desired balance can be created at the location of the shaped charge in the portion of the wellbore. Of course, other portions of the wellbore can also be affected by the detonation of the main explosive load, but at least the portion of the wellbore immediately adjacent to the shaped charge is affected and the desired balance is created at least in that portion of the wellbore. The desired balance can be a balanced wellbore, under-balanced wellbore, or an over-balanced wellbore. The desired balance is created by increasing or decreasing the dynamic pressure or increasing or decreasing the duration of a pressure pulse created during detonation of the shaped charge. As discussed above, the substance increases or decreases the dynamic pressure or increases or decreases the duration of a pressure pulse during detonation, which is more than is naturally occurring in a shaped charge without the substance. The substance can also increase or decrease the pressure differential between the wellbore 11 and the subterranean formation 20. The desired balance of the wellbore can be predetermined. One factor in determining the desired balance can be the hydrostatic pressure of the well. Hydrostatic pressure is the force per unit area exerted by a column of fluid at rest. In US oilfield units, hydrostatic pressure is calculated using the equation: P=MW*Depth*0.052, where MW is the drilling fluid density in pounds per gallon, Depth is the true vertical depth or "head" in feet, and 0.052 is a unit conversion factor chosen such that P results in units of pounds per square inch (psi). The hydrostatic pressure is the force exerted on the wellbore components, such as a tubing string or casing, or a subterranean formation for an open-hole wellbore portion via the fluid located in the wellbore. By way of example, if the hydrostatic pressure is large, then the desired balance of the wellbore may be under balanced; and by contrast if the hydrostatic pressure is small, then the desired balance of the wellbore may be balanced or over balanced.

The dynamic pressure created during detonation can be increased or decreased via an increase in the amount of heat of explosion of the main explosive load 102 (i.e., the amount of heat produced during detonation of the main explosive load). The generation of heat in large quantities accompanies most explosive chemical reactions. It is the rapid liberation of heat that causes the gaseous products of most explosive reactions to expand and generate high pressures. This rapid generation of high pressures of the released gas constitutes the explosion. The strength, or potential, of an explosive is the total work that can be performed by the gas resulting from its explosion, when expanded adiabatically from its original volume, until its pressure is reduced to atmospheric pressure and its temperature to 15° C. The potential is therefore the total quantity of heat given off at constant volume when expressed in equivalent work units and is a measure of the strength of the explosive. Each product and reactant making up the explosive load will have a specific heat of formation. The standard heat of formation of a compound is the change of enthalpy that accompanies the formation of 1 mole of the compound from its elements, with all substances being in their standard states. The heat released by the explosive material can be calculated as follows:

$$HEX=\Delta U=|U_{prod1}-U_{react1}|+|U_{prod2}-U_{react2}| \ldots .$$

where HEX refers to the heat of explosion in units of calories per gram mole (cal/g mole); ΔU is the change in absolute enthalpy of a system at the starting and ending states for the calorimetric reaction; and $U_{prod}$ and $U_{react}$ are the internal energies of the products and reactants (1, 2, and so on), respectively, at standard reference conditions of room temperature (i.e., at 25° C. (298.15 K)), 1 atm, gaseous substances in ideal state. The heat released can be referred to as the "heat of explosion" (HEX). According to an embodiment, the substance 200 causes an increase in the heat of explosion of the main explosive load 102. With an increase in HEX, the explosive load has an increased ability to do work. This increased ability to do work means that the dynamic pressure can be increased compared to an explosive load without the increase in HEX. According to another embodiment, the substance 200 causes a decrease in the heat of explosion of the main explosive load 102. With a decrease in HEX, the explosive load has a decreased ability to do work. This decreased ability to do work means that the dynamic pressure can be decreased compared to an explosive load without the decrease in HEX. According to an embodiment, the increase or decrease in the heat of explosion is predetermined. The predetermined heat of explosion can, in part, be calculated based on the desired increase or decrease in the dynamic pressure, the desired balance of the well, or the desired pressure differential (in the case of an over-balanced or under-balanced wellbore), but can also be derived from experimental data.

According to an embodiment, the substance increases the duration of the pressure pulse and creates an elongated pressure pulse. According to this embodiment, the substance burns slower or causes the explosive load to burn slower compared to a shaped charge without the substance. According to another embodiment, the substance decreases the duration of the pressure pulse and creates a shortened pressure pulse. According to this other embodiment, the substance burns faster or causes the explosive load to burn faster compared to a shaped charge without the substance. An increase in the duration of the pressure pulse can be used to create an over-balanced wellbore, and a decrease in the duration of the pressure pulse can be used to create an under-balanced wellbore. Of course, the increase or decrease can also be used to create a balanced wellbore depending on several factors, for example, the hydrostatic pressure in the wellbore.

The substance 200 for any of the embodiments, can be selected from the group consisting of metals, metal alloys, plastics, thermoplastics, fluoropolymers (e.g., polytetrafluoroethylene), and combinations thereof. The metal or metal alloy can be selected from, but is not limited to, the group consisting of aluminum, zinc, magnesium, titanium, tantalum, and combinations thereof. According to an embodiment, the substance is any substance that is capable of increasing or decreasing the overall heat of explosion of the main explosive load 102, thereby resulting in an overall increase or decrease in the ability to perform work, thereby increasing or decreasing the dynamic pressure. According to another embodiment, the substance is any substance that is capable of increasing or decreasing the duration of the pressure pulse. The quantity of the heat of explosion and overall work energy can vary and will depend on the heat of formation of the specific substance(s) chosen. For example, the heat of formation of aluminum oxide ($Al_2O$) is 163 kilojoules per mole (kJ/mol) and the heat of formation of aluminum III oxide ($Al_2O_3$) is 1,590 kJ/mol. The substance 200 can produce an exothermic reaction when reacted with one or more materials of the shaped charge 100 (e.g., the main explosive load 102) or perforating gun assembly 300 and thereby increases the heat of explosion. An exothermic reaction might be useful when an over-balanced wellbore is desired or when a balanced wellbore is desired and the hydrostatic pressure of the wellbore is substantially less than the pore pressure of the formation. The substance 200 can also produce an endothermic reaction when reacted with one or more materials of the shaped charge 100 (e.g., the main explosive load 102) or perforating gun assembly 300 and thereby decreases the heat of explosion. An endothermic reaction might be useful when an under-balanced wellbore is desired or when a balanced wellbore is desired and the hydrostatic pressure of the wellbore is substantially greater than the pore pressure of the formation. According to an embodiment, the substance is selected such that a desired heat of explosion is achieved.

The quantity of the heat of explosion can depend on the size and shape of the substance 200. The size and shape of the substance 200 can be selected such that the desired heat of explosion, the desired dynamic pressure, the desired duration of the pressure pulse, and/or the desired balance is achieved. The substance 200 can have a largest cross-sectional size in the range from 64 millimeters (mm) to less than 0.1 micrometers (0.1 μm or 0.1 microns). By way of example, the size of the substance 200 can be selected from the group consisting of gravel, sand, bulk particles, mesoscopic particles, or nanoparticles. As used herein, "gravel" is a particle having a particle size in the range of 2 to 64 mm. As used herein, "sand" is a particle having a particle size in the range of 62.5 microns to 2 mm. As used herein, a "bulk particle" is a particle having a particle size in the range of greater than 1 micron to 62.4 microns. As used herein, a "mesoscopic particle" is a particle having a particle size in the range of 1 micron to 0.1 microns. As used herein, a "nanoparticle" is a particle having a particle size of less than 0.1 microns. As used herein, the term "particle size" refers to the volume surface mean diameter ("$D_s$"), which is related to the specific surface area of the particle. The volume surface mean diameter may be defined by the following equation: $D_s=6/(\Phi_s A_w \rho_p)$, where $\Phi_s$=sphericity; $A_w$=specific surface area; and $\rho_p$=particle density. According to an embodiment, the shape and particle size of the substance 200 is selected such that the substance has a desired surface area. The desired surface area can be an area such that the heat of explosion or the dynamic pressure is increased or decreased.

If the substance 200 is in the form of a disc secured to the charge case 101 (as depicted in FIGS. 3-5) or coats at least a portion of the charge tube 301 or carrier 303, then the thickness of the substance 200 can be selected such that the desired heat of explosion, the desired dynamic pressure, the desired duration of the pressure pulse, and/or the desired balance is achieved.

Although the drawings depict the location of the substance 200 according to certain embodiments, the substance or more than one substance can be located in a multitude of locations in the main explosive load 102 or adjacent to the main explosive load. If the substance 200 is located adjacent to the main explosive load 102, then preferably the substance is located within a proximity such that the desired heat of explosion, the desired dynamic pressure, the desired duration of the pressure pulse, and/or the desired balance is achieved. By way of example, the substance 200 can be located close enough to the main explosive load 102 such that the substance is capable of reacting with the main explosive load to increase or decrease the heat of explosion of the main explosive load, thereby increasing or decreasing the dynamic pressure created during detonation, thereby creating the desired balance of the wellbore. The closer the substance is to the main explosive load, the greater probability that the substance will react with the main explosive load.

The quantity of the heat of explosion can also depend on the concentration of the one or more substances. Generally, the greater the concentration of the substance, the greater the heat of explosion or the dynamic pressure can increase or decrease, depending on the substance chosen (e.g., an exothermic or endothermic substance). According to an embodiment, the concentration of the substance is selected such that the desired heat of explosion, the desired dynamic pressure, the desired duration of the pressure pulse, and/or the desired balance is achieved. According to another embodiment, the substance is in a concentration of at least 0.05% by weight of the main explosive load 102. According to yet another embodiment, the substance is in a concentration in the range of about 0.05% to about 40%, preferably about 1% to about 25%, by weight of the main explosive load 102.

The heat of explosion can be affected by the oxygen balance of the explosive. Oxygen balance (OB or OB %) indicates the degree to which an explosive can be oxidized. For example, most explosives are made up of carbon, hydrogen, nitrogen, and oxygen. If an explosive molecule (CHNO) contains just enough oxygen to form carbon dioxide from carbon, and water from hydrogen molecules then the explosive has a zero oxygen balance. An explosive has a positive oxygen balance if the explosive contains more oxygen than needed, and an explosive has a negative oxygen balance if the explosive contains less oxygen than needed. If the explosive has a negative oxygen balance, then the combustion of the explosive molecules will be incomplete, and large amounts of toxic gases such as carbon monoxide will be present. Generally, when a positive or zero OB is present, the heat of explosion will be the greatest; whereas, the heat of explosion will be less when a negative OB is present. According to an embodiment, the main explosive load 102 has a positive or zero OB. According to another embodiment, a sufficient amount of oxygen ($O_2$) is available to cause complete combustion of the main explosive load 102. The available $O_2$ can come from the substance, part of another material (e.g., the booster), and/or the area surrounding the shaped charge.

The substance can be selected such that at least a sufficient amount of oxygen is available in order to achieve complete combustion of the main explosive load 102. The substance can also be selected such that at least a sufficient amount of oxygen is available in order to achieve the predetermined heat of explosion or dynamic pressure. The concentration of the substance can also be selected such that at least a sufficient amount of oxygen is available in order to achieve complete combustion of the main explosive load; alternatively, such that at least a sufficient amount of oxygen is available in order to achieve the predetermined heat of explosion; alternatively, such that the desired increase or decrease in the dynamic pressure or increase or decrease in the duration of the pressure pulse created during detonation is achieved. By way of example, $Al_2O_3$ can provide more available oxygen compared to $Al_2O$. The substance and/or the concentration of the substance can also be selected based on the quantity of available oxygen present in the area surrounding the positioned shaped charge.

The substance can also form available oxygen by reacting with other unoxidized elements or compounds present in the system. The substance can also increase the heat of explosion or dynamic pressure by reacting with other unoxidized elements or compounds present in the system. By way of example, if the substance is $Al_2O$ and a negative OB is present, then the formation of $Al_2O_3$ via a reaction of the $Al_2O$ and other unoxidized compounds or elements can occur. The formation of $Al_2O_3$ is a highly exothermic chemical reaction and can increase the overall heat of explosion and dynamic pressure.

The methods include the step of positioning the shaped charge 100 in the wellbore 11. The step of positioning can comprise inserting the shaped charge 100 into the well. The shaped charge 100 can be positioned in the wellbore 11 at a desired location. According to an embodiment, the desired location is the location at which a perforation tunnel 22 is to be created. The following depicts one example of methods of use in multiple zones of a formation, but is not the only example of use that could be given. One or more first shaped charges can be positioned in the first zone 16 and one or more second shaped charges can be positioned in the second zone 17. The first shaped charge can include a first substance and the second shaped charge can include a second substance. The first and second substance can be the same or different. Moreover, the size, shape, concentration, and location of the first and second substance can be the same or different. By way of example, it may be desirable for an over balance to occur in the first zone 16 and for an under balance to occur in the second zone 17. Therefore, if it is desirable to increase the dynamic pressure during detonation in the first zone 16 and decrease the dynamic pressure in the second zone 17, then the first substance can create an increase in the heat of explosion of the one or more first shaped charges located in the first zone 16 and the second substance can decrease the heat of explosion of the shaped charge(s) located in the second zone 17. According to this example, the first substance can produce an exothermic reaction when reacted with the main explosive load of the first shaped charges and the second substance can produce an endothermic reaction when reacted with the main explosive load of the second shaped charges. It is to be understood that numerous combinations could be created between zones and even within a particular zone by modifying the substance and other parameters for all shaped charges located within each zone or for one or more charges located within a particular zone. It is also to be understood that the change (i.e., increase or decrease) in the dynamic pressure and/or heat of explosion for each shaped charge can be the same or different. Moreover, each shaped charge can create a balance, under balance, or over balance at the location of the shaped charge. The amount of balance can also be the same or different for each zone.

The methods can further include the step of inserting the shaped charge 100 into a charge tube 301, wherein the step of inserting the shaped charge is performed prior to the step of positioning. More than one shaped charge can be inserted into the charge tube 301. The methods can further include the step of inserting the charge tube 301 into a carrier 303, wherein the step of inserting the charge tube into the carrier is performed after the step of inserting the shaped charge into the charge tube. The charge tube 301 and the carrier 303 can be part of a perforating gun assembly 300. The step of positioning can further comprise inserting the perforating gun assembly 300 into the wellbore 11.

The methods can further comprise the step of detonating the main explosive load 102, wherein the step of detonating is performed after the step of positioning. According to an embodiment, the detonation of the main explosive increases or decreases the dynamic pressure created during detonation of the main explosive load. According to another embodiment, the detonation of the main explosive increases or decreases the duration of the pressure pulse created during detonation of the main explosive load. The detonation of the main explosive load can be detonating the shaped charge. According to another embodiment, the detonation of the main explosive load creates a balanced, over-balanced, or under-balanced wellbore. The step of detonating can comprise causing initiation of the main explosive load 102. The initiation of the main explosive load 102 can include initiating the booster 106, booster array, or detonation wave guide. The initiation of the booster, booster array, or detonation wave guide can include detonating a detonation cord. The detonation cord can be used to: detonate the main explosive load and the substance; detonate the main explosive load and cause a chemical reaction between the substance and another material; or detonate the main explosive load wherein the detonation of the main explosive load causes detonation or a chemical reaction of the substance.

The methods can further include the step of creating a perforation tunnel. According to an embodiment, the detonation of the main explosive load 102, and the jet produced by the liner material 103, creates the perforation tunnel 22. More than one main explosive load 102 can be detonated. As can be seen in FIG. 1, a first main explosive load 102 located in the first zone 16 can be detonated; thereby creating a first perforation tunnel 22, a second main explosive load shown located in the third zone 18 can be detonated; thereby creating a second perforation tunnel, and so on. Of course more than one main explosive load can be detonated within a given zone. Moreover, not every zone need include a shaped charge and the exact zones that contain a shaped charge and the total number of shaped charges positioned within those zones can vary depending on the specifics of the particular oil or gas operation.

The methods can further comprise the step of fracturing at least a portion of the subterranean formation 20, wherein the step of fracturing is performed after the step of positioning or after the step of detonating. The step of fracturing can include introducing a fracturing fluid into at least one of the perforation tunnels 22. The methods can further include the step of performing an acidizing treatment in at least a portion of the subterranean formation 20, wherein the step of performing an acidizing treatment is performed after the step of positioning or after the step of detonating. The step of performing an acidizing treatment can include introducing an acidizing fluid into at least one of the perforation tunnels 22.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is, therefore, evident that the particular illustrative embodiments disclosed above may be altered or modified and all such variations are considered within the scope and spirit of the present invention. While compositions and methods are described in terms of "comprising," "containing," or "including" various components or steps, the compositions and methods also can "consist essentially of" or "consist of" the various components and steps. Whenever a numerical range with a lower limit and an upper limit is disclosed, any number and any included range falling within the range is specifically disclosed. In particular, every range of values (of the form, "from about a to about b," or, equivalently, "from approximately a to b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an", as used in the claims, are defined herein to mean one or more than one of the element that it introduces. If there is any conflict in the usages of a word or term in this specification and one or more patent(s) or other documents that may be incorporated herein by reference, the definitions that are consistent with this specification should be adopted.

What is claimed is:

1. A method of controlling a dynamic pressure created during detonation of a shaped charge comprising:

positioning the shaped charge in a wellbore, wherein the shaped charge comprises a main explosive load enclosed between a charge case and a liner, and wherein a substance is positioned proximate to the main explosive load and forms an outer surface of the shaped charge, the outer surface being external to the main explosive load and liner, and having an outer surface that faces away from the charge case, main explosive load, and liner; wherein the substance is positioned within an inner diameter of a cavity of the charge case; and wherein the substance increases or decreases the dynamic pressure or the duration of a pressure pulse created during detonation of the shaped charge relative to a substantially identical shaped charge that does not include the substance.

2. The method according to claim 1, wherein the main explosive load further comprises an explosive material.

3. The method according to claim 2, wherein the explosive material is selected from the group consisting of [3-Nitrooxy-2,2-bis (nitrooxymethyl) propyl] nitrate "PETN"; 1,3,5-Trinitroperhydro-1,3,5-triazine "ROX"; Octahydro-1,3,5,7-tetranitro-1,3,5,7-tetrazocine "HMX"; 1,3,5-Trinitro-2-[2-(2,4,6-trinitrophenyl) ethenyl] benzene "HNS"; 2,6-bis, bis (picrylamino)-3,5-dinitropyridine "PYX"; 1,3,5-trinitro-2,4,6-tripicrylbenzene "BRX"; 2,2',2",4,4',4",6,6',6"-nonanitro-m-terphenyl "NONA"; and combinations thereof.

4. The method according to claim 1, wherein the substance is selected from the group consisting of metals, metal alloys, plastics, thermoplastics, fluoropolymers, and combinations thereof.

5. The method according to claim 1, wherein the substance comprises a metallic material selected from the group consisting of aluminum, zinc, magnesium, titanium, tantalum, and combinations thereof.

6. The method according to claim 1, wherein the substance includes one or more protrusions making up the outer diameter of the substance, wherein the protrusions secure the substance to the outside of the base of the charge case.

7. The method according to claim 1, wherein the shaped charge is included in a perforating gun assembly.

8. The method according to claim 7, wherein the perforating gun assembly comprises a charge tube and a carrier.

9. The method according to claim 8, wherein the charge tube comprises a layer of the substance partially or fully surrounding the outer perimeter of one or more holes of the charge tube, partially or fully coating the inside or the outside of the charge tube, or combinations thereof.

10. The method according to claim 8, wherein the carrier comprises a secondary layer of the substance partially or fully coating the inside of the carrier.

11. The method according to claim 1, wherein the substance increases the heat of explosion of the main explosive load and wherein the substance produces an exothermic reaction when reacted with one or more materials.

12. The method according to claim 1, wherein the substance decreases the heat of explosion of the main explosive load and wherein the substance produces an endothermic reaction when reacted with one or more materials.

13. The method according to claim 1, wherein the dynamic pressure created during detonation is increased or decreased via an increase in the amount of heat of explosion of the main explosive load.

14. The method according to claim 13, wherein the substance is any substance that increases or decreases the overall heat of explosion of the main explosive load.

15. The method according to claim 1, wherein the increase or decrease in the dynamic pressure is a desired value.

16. The method according to claim 15, wherein the size and shape of the substance is selected such that the desired dynamic pressure is achieved.

17. The method according to claim 15, wherein the concentration of the substance is selected such that the desired dynamic pressure is achieved.

18. The method according to claim 1, further comprising the step of detonating the main explosive load, wherein the step of detonating is performed after the step of positioning.

19. A method of controlling the balance of a portion of a wellbore comprising:

positioning a shaped charge in the portion of the wellbore, wherein the shaped charge comprises a main explosive load enclosed between a charge case and a liner, wherein a substance is positioned proximate to the main explosive load and forms an outer surface of the shaped charge, the outer surface being external to the main explosive load and liner, and having an outer surface that faces away from the charge case, main explosive load, and liner; wherein the substance is positioned within an inner diameter of a cavity of the charge case; and creating a desired balance in the portion of the wellbore, wherein the desired balance is created by increasing or decreasing a dynamic pressure or increasing or decreasing the duration of a pressure pulse created during detonation of the shaped charge, wherein the substance increases or decreases the dynamic pressure or increases or decreases the duration of the pressure pulse created during detonation of the shaped charge; whereas a substantially identical shaped charge without the substance does not increase or decrease the dynamic pressure nor increase or decrease the duration of the pressure pulse during detonation.

20. The method according to claim 19, wherein the desired balance is a balanced wellbore portion.

21. The method according to claim 19, wherein the desired balance is an under-balanced wellbore portion.

22. The method according to claim 19, wherein the desired balance is an over-balanced wellbore portion.

* * * * *